United States Patent [19]

Jünemann et al.

[11] Patent Number: 4,574,717

[45] Date of Patent: Mar. 11, 1986

[54] WORKPIECE CLAMP FOR A SEWING DEVICE

[75] Inventors: Hubert Jünemann; Samuel Römich, both of Bielefeld, Fed. Rep. of Germany

[73] Assignee: Kochs Adler AG, Bielefeld, Fed. Rep. of Germany

[21] Appl. No.: 695,446

[22] Filed: Jan. 28, 1985

[30] Foreign Application Priority Data

Feb. 17, 1984 [DE] Fed. Rep. of Germany ..... 3405721

[51] Int. Cl.[4] ..... D05B 21/00

[52] U.S. Cl. ..... 112/121.12; 112/121.22; 112/121.15

[58] Field of Search ..... 112/121.22, 121.15, 112/136, 153, 121.11, 121.12

[56] References Cited

U.S. PATENT DOCUMENTS 3,315,625 4/1967 Bennison ..... 112/121.12 X
3,721,202 3/1973 Dodsworth ..... 112/121.15
3,749,038 7/1973 Dodsworth ..... 112/121.15

FOREIGN PATENT DOCUMENTS 2110256 6/1983 United Kingdom ..... 112/121.22
2139655 11/1984 United Kingdom ..... 112/121.22

*Primary Examiner*—H. Hampton Hunter
*Attorney, Agent, or Firm*—Max Fogiel

[57] ABSTRACT

A workpiece clamp of sewing devices for sewing the marginal zones of a lining cut and a necktie cut in the area of the tip and the lateral corners of a necktie. The clamp is equipped with three clamping plates hingedly connected to each other, for clampably receiving the lining cut and the necktie cut between the clamping plates. The intermediate clamping plate is provided, at the surface directed to the necktie cut, with central folding web and lateral webs for forming a center fold and lateral folds. The upper clamping plate is provided with folding blades for folding and holding down the lateral folds in coaction with the clamping plates for clamping the workpieces to be stitched together.

5 Claims, 8 Drawing Figures

WORKPIECE CLAMP FOR A SEWING DEVICE

BACKGROUND OF THE INVENTION

The present invention relates generally to a workpiece clamp for a sewing device for clampingly receiving workpiece layers to be stitched together at their margins and, in particular, to a workpiece clamp for sewing a tip area of a necktie.

From a brochure (AMF, Inc., Model 84-23 TT) such a workpiece clamp to be used in a sewing device is known. It is essentially composed of clamping plates hingedly connected with each other.

For sewing the tip of a necktie, at first a lining cut is positioned on a supporting plate and clamped thereto by means of an intermediate clamping plate lowered upon the supporting plate. Subsequently, the tip area of the necktie cut is positioned on the intermediate clamping plate and clamped thereto by means of an upper clamping plate lowered upon the intermediate clamping plate.

A special feature of this workpiece clamp is a folding sword arranged along the symmetry of the intermediate clamping plate. The necktie cut is folded about this sword when the upper clamping plate is lowered upon the intermediate clamping plate, thus forming a center fold. A further special feature are webs formed at the intermediate clamping plate for producing folds in order to meet the material fullness in this area. Besides the formation of the aforesaid three folds, at the marginal zones of the necktie cut to be sewn to the lining cut, there is produced an additional material fullness due to the thickness of the intermediate clamping plate.

After clamping of the lining cut and the necktie cut, and forming the aforesaid material fullness, both workpiece cuts are sewn together at their marginal zones. For this purpose, the sewing device includes guiding means in order to control a relative movement between the workpiece clamp and the sewing machine, according to the profile of the seam to be produced.

During the sewing operation, at first one lateral corner is reached, at which the fullness fold located in this area of the necktie cut is folded down by the seam and into the direction of the seam. In the area of the tip where the center fold ends, there is an automatically controlled interruption of the seam. Subsequently, a new seam is started for sewing the marginal zones of the workpiece cuts. As soon as the second lateral corner is reached, the fullness fold located in this area of the necktie cut is folded down by the seam and also in the direction of the seam generation. Finally, the seam is completed along the remaining shank.

By the afore-described sewing operation, the folds at the lateral corners are folded down and sewn in sewing direction, i.e. in different directions with respect to the necktie itself. When turning these areas of the necktie, the different sewing of the lateral fullness folds causes unequal conditions, which influence the appearance of the necktie and which renders difficult the production of a parallelly extending profile of the lining cut sewn to the necktie cut. These difficulties especially may occur if the texture of the materials to be sewn differs considerably.

SUMMARY OF THE INVENTION

It is a main object of the present invention to provide a workpiece clamp for sewing necktie tips of improved quality, in which the lateral folds generated in the necktie cut are unidirectionally folded over and secured by the seam to be produced for connecting the necktie cut and the lining cut.

It is a further object of the present invention to provide a workpiece clamp of the aforesaid type, at which the fullness in the necktie cut is formed in definite and sequential steps.

Another object of the present invention is to provide a workpiece clamp of the aforesaid type, which is simple in construction and reliable in operation.

The present invention has been provided to eliminate the shortcomings of the prior art and to provide a workpiece clamp, which is capable of producing necktie tips of a higher quality.

The workpiece clamp according to the present invention renders possible that the lateral folds are definitely and uniformly folded and fixed in this condition by a seam. The uniform conditions that are achieved in this manner ensure uniform appearance of the necktie cut after turning. Furthermore, it is achieved that there are no upwardly extending folds in the lateral corners, which may cause skip stitches. Thus, the workpiece clamp according to the invention ensures a seam that is stitched without skipping and excludes any repair stitching.

The construction of the workpiece clamp according to further features ensures that the various folding processes run one after another thereby meeting the material fullness at definite positions.

According to another feature of the construction, the webs required for forming the lateral folds support the necktie cut at its marginal zones, without hindering the successive operations.

Other objects, advantages and features of the present invention will appear from the detailed description of two embodiments, which will now be explained in conjunction with the accompanying drawings.

Figure 1:
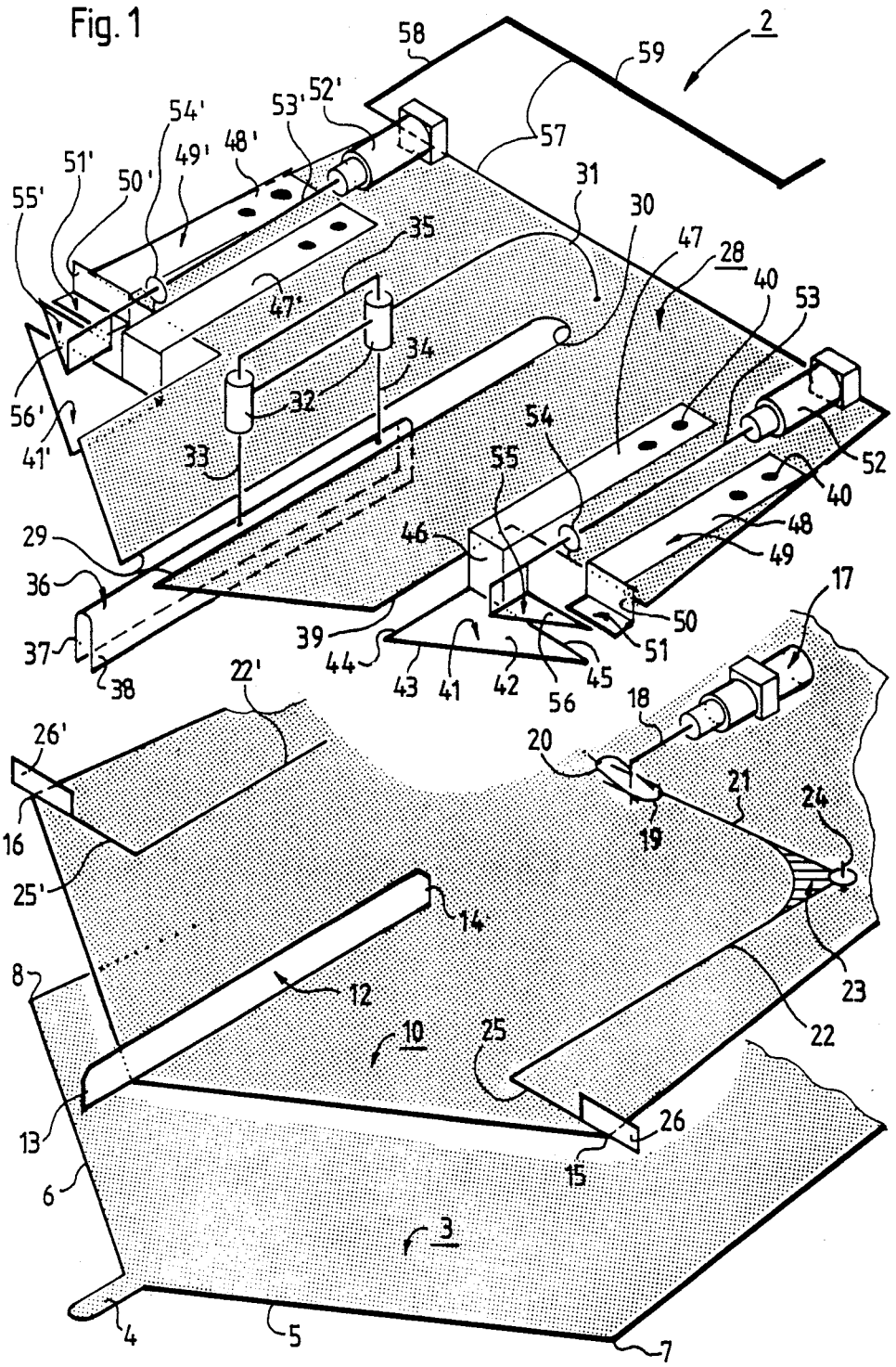
FIG. 1 is a schematic perspective view of the clamping area of a workpiece clamp according to a first embodiment of the present invention.
Figure 4:
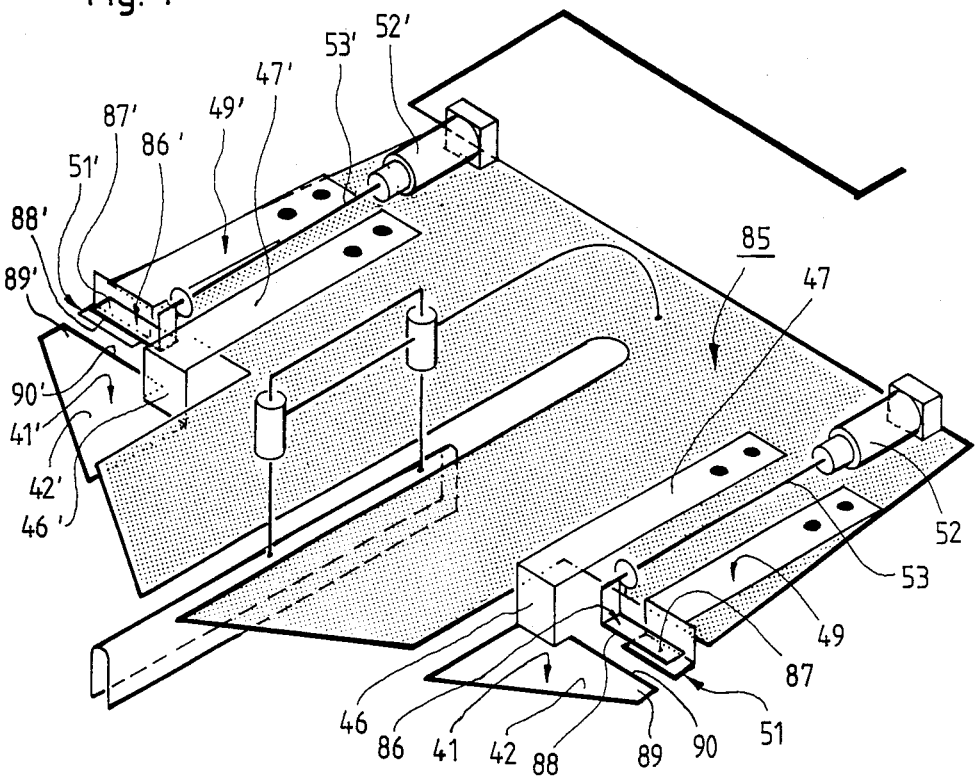
Figure 5:
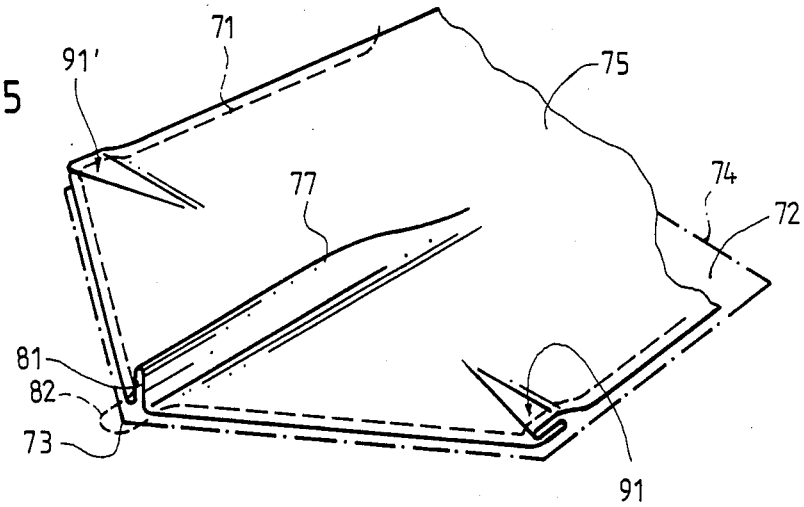

FIGS. *3a–3d* show workpiece cuts to be sewn, the upper material layer of which being positioned in different folding conditions;

FIG. 4 shows a portion of the workpiece clamp illustrated in FIG. 1, according to a second embodiment; and FIG. 5 is a representation according to FIG. *3d* showing the folds positioned according to the second embodiment.

DESCRIPTION OF THE PREFERRED EMBODIMENTS

FIRST EMBODIMENT

Figure 2:
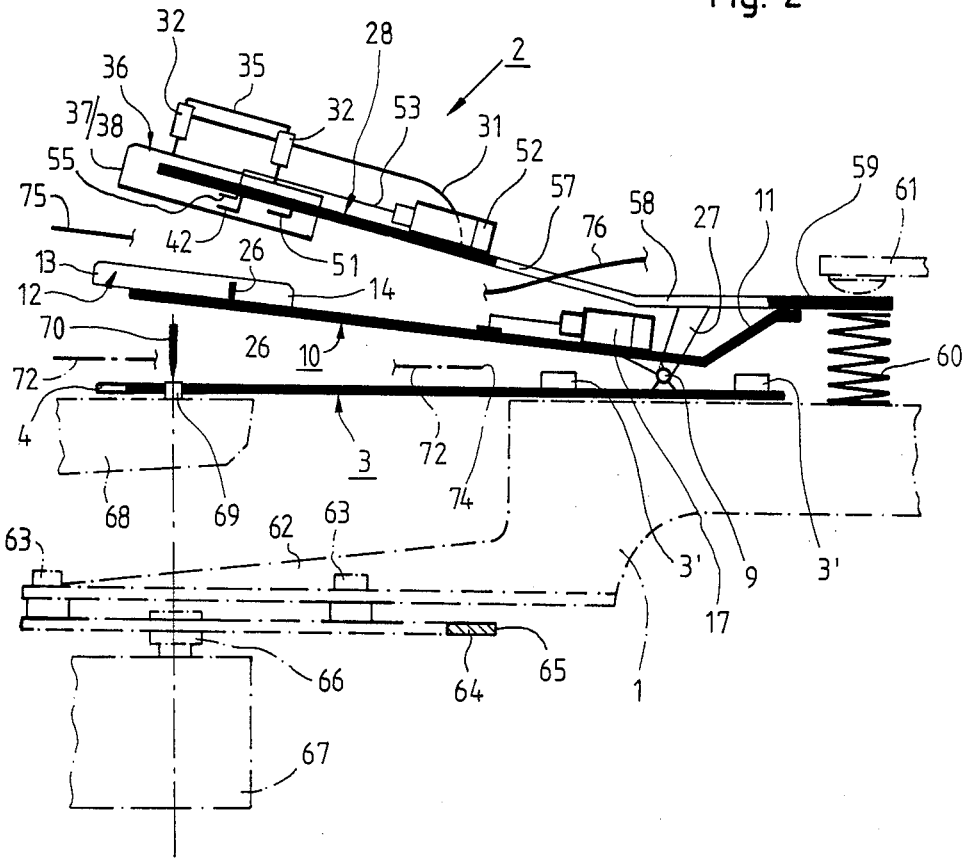
FIG. 2 is a schematic side elevation of the workpiece clamp in opened position.

Referring more particularly to the drawings, in FIGS. 1 and 2 there is illustrated a workpiece clamp 2, the supporting plate 3 of which is fastened by screws 3' to a carrier 1 of a sewing device, not shown. The supporting plate 3 is profiled according to FIG. 1 and formed at its tip with a tongue 4, from which extend shanks 5, 6 to two lateral corners 7, 8. Furthermore, at the mounting area of the supporting plate 3 there is arranged a bearing 9 having an axis of rotation extending parallel with respect to the plane of the supporting plate 3 and rectangularly with respect to the axis (not shown) of symmetry of the supporting plate 3.

In the bearing 9 there is pivoted an intermediate clamping plate 10, substantially profiled according to the supporting plate 3. The intermediate clamping plate 10 is formed with a right end 11 angularly extending upwards and then parallel with respect to the supporting plate 3. In parallel with the longitudinal axis of symmetry of the intermediate clamping plate 10, there is provided a web 12, which rectangularly projects upwards with respect to the plane of the intermediate clamping plate 10. The web 12 is formed with a front end 13 according to the overhang of the tongue 4, and a rear end 14 terminating in the center of the intermediate clamping plate 10. In order to simplify the description, the right and left corners of the intermediate clamping plate 10 are denoted by 15, 16. The geometry of the corners 15, 16 is as that of the corners 7, 8.

According to FIG. 1, in the area of the bearing 9 of the intermediate clamping plate 10, there is arranged a drive cylinder 17, the piston rod 18 of which pivotally engages into two superposed forks 19, 20. The fork 19 forms the end of an arm 21, which in turn forms, together with a further arm 22, a triangular lever 23, which is rotatably received in a bearing 24 located on the intermediate clamping plate 10. The free end of the arm 22 is formed with a bent-off portion 25 terminating in a right folding web 26. The folding web 26 extends upwardly into the right corner 15. In the left corner 16 there is arranged a left folding web 26', which extends symmetrically with respect to the longitudinal axis of the intermediate clamping plate 10 and is connected to the fork 20, such as a triangular lever 23.

Furthermore, the bearing 9 receives a web 27 connected to an upper clamping plate 28. According to FIG. 1, the upper clamping plate 28 is formed with a recess 29 extending along the longitudinal axis of the upper clamping plate 28 and ending in an area 30. The upper clamping plate 28 carries an arm 31 extending rectangularly with respect to the plane of the upper clamping plate 28 and to the tip area not denoted, of the latter. The arm 31 is provided with two slide bearings 32. In the slide bearings 32 there are slidably received shanks 33, 34 of a sliding frame 35 having the shape of a downwardly extending U. The ends of the shanks 33, 34 are connected to a folding piece 36 having two folding webs 37, 38 forming a downwardly directed U. The aforesaid mounting of the folding piece 36 ensures a free movement with respect to the upper clamping plate 28 due to gravity. However, also spring means may be provided for such positioning of the folding piece 36 relative to the upper clamping plate 28.

In the following description there are only described those elements which are located on one half of the upper clamping plate 28. Consequently, the elements symmetrically arranged on the other half are denoted with the same Ref. Nos. but followed by an apostrophe (i.g. folding plate 49=49').

Moreover, the upper clamping plate 28 is provided with an angular recess 39 for receiving a right folding plate 41. The folding plate 41 is formed as a triangular surface 42 having a side 43 and two sides 44, 45 extending rectangularly to each other. The triangular surface 42 is formed with a vertically extending web 46 terminating in a bent-off end 47. The end 47 is yieldably connected against internal stress to the clamping plate 28 by rivets 40.

Furthermore, a web 48 of a folding plate 49 is secured to the upper clamping plate 28 by rivets 40. The web 48 is formed with a downwardly bent section 50, which terminates in a bent-off folding member 51. As obvious from FIG. 2, the individual folding elements are formed so as to be stepwise arranged to each other at the lifted upper clamping plate 28. Thus, the folding members 51, 51' are positioned in a close distance and the lower surfaces of the folding webs 37, 38 in a remote distance to the upper clamping plate 28, while the surfaces 42, 42' are located in an intermediate position.

The upper clamping plate 28 carries a working cylinder 52, the piston rod 53 of which is axially displaceable guided in a bearing 54 of the upper clamping plate 28 and is provided with a right folding blade 55. The right folding blade 55 is formed with a triangular folder 56, which extends parallel with respect to the upper clamping plate 28, but above the folding member 51. As obvious from FIG. 2, the afore-described elements (surface 42, folding member 51) are mounted so as to axially lap over the folding web 26 when the clamping plates 28, 10 are swung together. The upper clamping plate 28 is provided with a recess 57, at which the web 27 is secured to a shank 58. The shank terminates in section 59, which is displaced by the tension of a spring 60 in counter clockwise direction as seen from FIG. 2. The section 59 projects into the working area of a pressure lever 61. For operating the workpiece clamp 2, the pressure lever 61 is movable up- and down-wardly into two extreme positions and into an intermediate position by described operating means (not described).

Figure 3A:
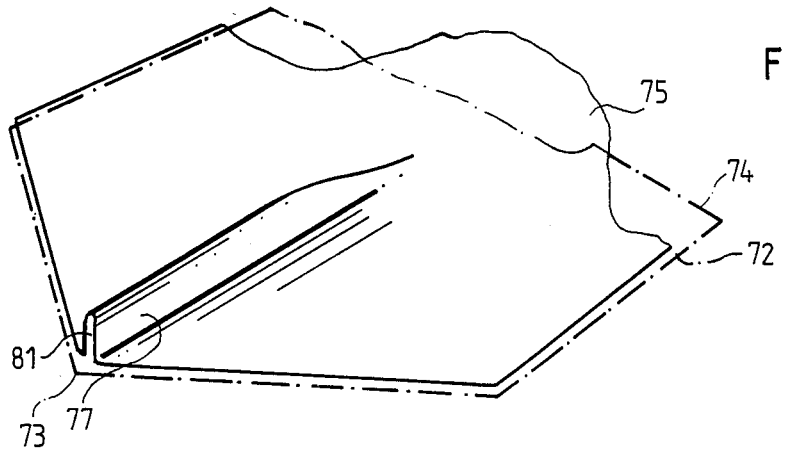
Figure 3B:
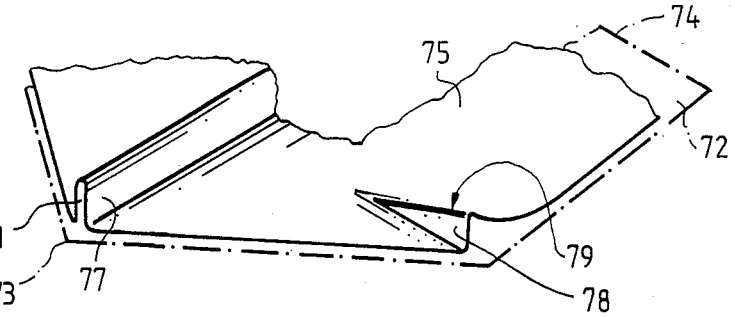
Figure 3C:
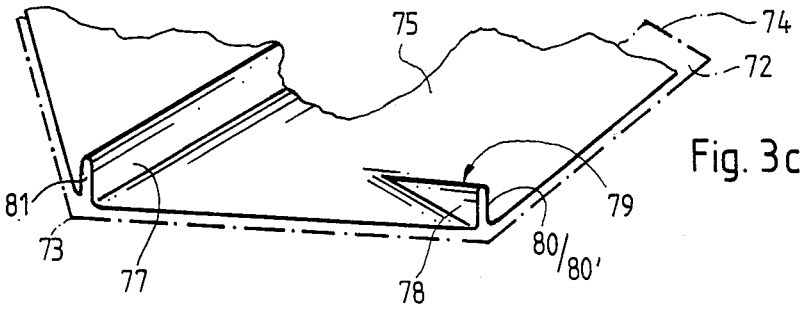
Figure 3D:
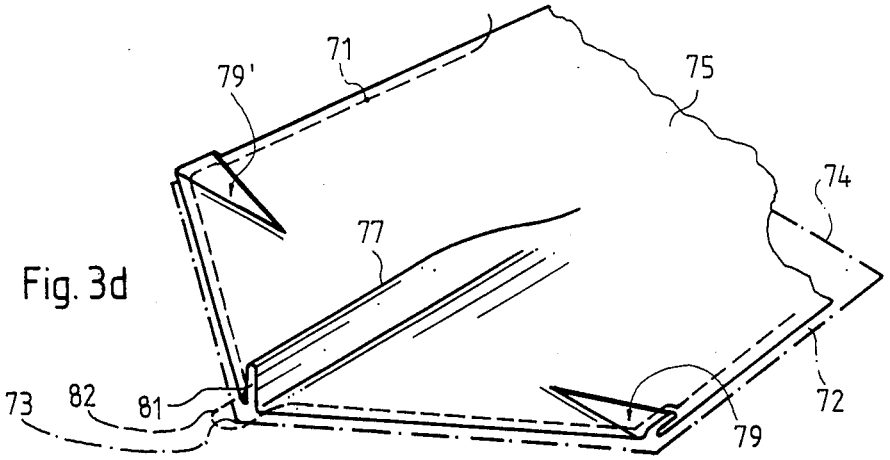

According to FIG. 2, the carrier 1 is formed with a bracket 62, to which a template 64 is fastened by screws 63. The template 64 is formed at its inner surface 65 for rolling off of a magnetic roller 66, which is drivably pivoted in an arm 67. The arm 67 is connected to a sewing machine moveably arranged in the sewing plane. In FIG. 2 only the lower arm 68 of the sewing machine is illustrated. To the lower arm 68 there is secured a projecting stud 69, which extends axially to a needle 70 of the sewing machine and the axis of rotation of the magnetic roller 66. The stud 69 extends upwardly in accordance with the thickness of the supporting plate 3 in order to support the workpiece margins. The inner surface 65 of the template 64 is profiled so that, when the magnetic roller 66 moves along the template 64, the needle 70 moves along the workpiece clamp 2 in accordance with the profile of a seam 71 to be produced (FIG. 3*d*).

The working cylinders 17, 52, 52' arranged at the workpiece clamp 2 are connected by hoses to valves (both not shown), at which the latters are controlled by the machine control. The carrier 1 may also be a component of a rotary table rotating about a vertical axis. In this case, a plurality of such carriers are radially arranged as disclosed for example in German Pat. No. 14 85 205 which corresponds to U.S. Pat. No. 3,405,670, as well as in U.S. Pat. No. 3,428,005.

Operation of the workpiece clamp 2 is described as follows:

In the starting position according to FIG. 2, the intermediate (10) and the upper clamping plate 28 are in lifted positions with respect to the supporting plate 3, what is caused by the actuation of the pressure lever 61. At this point, the sewing machine is in a position which permits the workpiece clamp 2 to be loaded without hindrance. In the following description, the positions of the individual folding elements illustrated in the drawings are defined as starting positions.

At first, a lining cut 72 is positioned between the supporting plate 3 and the intermediate clamping plate 10, i.e. placed upon the supporting plate 3. The lining cut 72 is positioned so that its tip 73 is centrally placed on the tongue 4 and that there is provided at all sides, except the rear edge 74, a uniform overhang of material with respect to the supporting plate 3.

When the operator actuates a pedal, the pressure lever 61 is brought into an intermediate position, so that the intermediate clamping plate 10 engages and clamps the inserted lining cut 72 due to the action of the spring 60 or the own weight of the intermediate clamping plate 10 or the upper clamping plate 28. Subsequently, a necktie cut 75 is positioned between the lowered intermediate clamping plate 10 and with respect to the latter, the still lifted upper clamping plate 28, where the end area of the necktie cut 75 rests upon the intermediate clamping plate 10, and the trailing end 76 is guided through the recess 57. At this instant, the piston rod 18 of the drive cylinder 17 and the folding webs 26, 26' are in extended positions. When inserting the necktie cut 75, it must be observed that sufficient material protrudes from all sides in the area of the seam 71 and the front end 13 of the web 12.

When actuating the pedal in a further switch step, the workpiece clamp 2 is completely closed due to a further displacement of the pressure lever 61 in connection with the relaxing spring 60. At this, the folding webs 37, 38 lap over the web 12 situated on the intermediate clamping plate 10, so that a center fold 77 is formed in the necktie cut 75 according to FIG. 3*a*. When forming this fold 77, it is important, that the surfaces 42, 42' of the folding plates 41, 41' and the folding members 51, 51' of the folding plates 49, 49' have not yet clamped the necktie cut 75 so as not to cause any additional stress in the materials 72, 75.

Subsequently, the surfaces 42, 42' of the folding plates 41, 41' engage the necktie cut 75 and form, in cooperation with the folding webs 26, 26', one side 78 of a left and a right corner fold 79, 79'. Also the folding members 51, 51' do not yet clamp the necktie cut 75, so that also the formation of the corner folds 79, 79' does not cause an additional stress in the necktie cut 75. Finally, also the folding members 51, 51' in connection with the folding webs 26, 26' engage the necktie cut 75 for forming the other side 80 of the corner folds 79, 79'. Thus, for producing the various folds in the necktie cut 75 and handling the material fullness, it is required to run the individual folding operations on a definite plan so as to cause no additional stress in the necktie cut 75. This is achieved by a stepwise actuation of the individual folding elements as the workpieces 72, 75 to be sewn are clamped area-wise and, in particular, at the external zones.

After the workpiece clamp 2 has been completely closed according to the above description, the control triggers to switch over the drive cylinder 17, so that the folding webs 26, 26' are moved into their retracted positions. Due to the principle of a common drive motion for both folding webs 26, 26', a simultaneous movement is induced for retracting, and exposing the folded necktie cut 75 to a minimum of distortion. This ensures that the subsequently displaced folding blades 55, 55' actuated by the working cylinders 52, 52' may fold the corner folds 79, 79' without hinderance, which then assume their positions as illustrated in FIG. 3*d*. The now completed folding procedure of the necktie cut 75 renders possible the sewing procedure, where the lining cut 72 is connected to the necktie cut 75 by the seam 71 and where the folding elements remain in their occupied positions.

The sewing machine is controlled in the area of the tongue 4, as the needle 70 moves about the tip 81 of the center fold 77, so that a curved seam area 82 is produced. This seam area 82 may be partially produced by a thread chain, (i.e. the stitches are not positioned in the lining cut 72), or by stitches formed in the lining cut 72 protruding in this area. Generally, the sewing operation is followed by a trimming operation, in order to remove excess material in the area of the seam 71.

After completing the seam 71, the completed workpiece may be removed. By actuating the pressure lever 61 against the tension of the spring 60, the clamping plates 10, 28 will be lifted, at which point the cylinders 17, 52, 52' still remain in their shift positions. At this point, the sewn workpiece is located on the intermediate clamping plate 10, i.e. the lining cut 72 and the necktie cut 75 enclose the intermediate clamping plate 10. When lifting the upper clamping plate 28 with respect to the intermediate clamping plate 10, there is sufficient space in the area of the sewn corner folds 79, 79', so that the folding members 51, 51' may slide out of them.

After terminating the lifting of the plates 10, 28, the necktie cut 75 and the lining cut 72 connected to each other, may be withdrawn from the intermediate clamping plate 10. The workpiece clamp 2 is opened, and the elastically constructed folding plates 41, 41' and the folding members 51, 51' are automatically returned into their starting positions while the folding blades 55, 55' and the folding webs 26, 26' are retracted in their starting positions by an actuated switch after removal of the sewn workpiece.

SECOND EMBODIMENT

The second embodiment of the workpiece clamp differs from the first embodiment by using a modified upper clamping plate 85 (FIG. 4). The geometric shape and the structure of the upper clamping plate 85 corresponds with that of the afore-described upper clamping plate 28 except for the hereinafter described folding elements. Also in this embodiment only the elements of one half of the upper clamping plate 85 are described and denoted. Corresponding elements of the other half are denoted accordingly, e.g. the right and the left folding plates are denoted with 41 and 41'.

To the piston rod 53 there is arranged a folding blade 86 having a rectangular folder 87 with an edge 88. The folder 87 extends parallel to the upper clamping plate 85, but above the folding member 51. The substantially triangular formed area 42 of the folding plate 41 is formed with a projection 89 terminating in an edge 90.

Operation of the workpiece clamp corresponds to that of embodiment 1, except for the working cylinders 52, 52'.

In the opened position of the workpiece clamp, the associated valves for actuating the working cylinders 52, 52' are operated so that the piston rods 53, 53' are in retracted positions. At this point, the edges 88, 88' of the right and left folding blades 86, 86' are positioned above the right and left folding members 51, 51' according to FIG. 4.

After loading the workpiece clamp, the necktie cut 75 is folded and lowered upon the lining cut 72, where the center fold 77 and the still upwardly directed right and left corner folds 79, 79' are formed according to FIG.

3c. In this condition, the edges 88, 88' of the right and left folding blades 86, 86' are each positioned at the sides 80, 80' of the right and left corner folds 79, 79' (FIG. 3c).

Now, as described in the first embodiment, the folding webs 26, 26' are retracted. Subsequently, by actuation of the associated valves, the piston rods 53, 53' of the working cylinders 52, 52' are extended. The edges 88, 90 or 88', 90' engage the upwardly directed corner folds 79, 79', so that they are simultaneously folded in the direction towards the tip 73. Consequently, the corner folds denoted in FIG. 5 with 91, 91' are folded in opposite direction with respect to the folded corner folds 79, 79' of the first embodiment. Due to the elastic construction of the edges 88, 88' the latter are capable of clamping the three layers of the necktie cut 75 at the corner folds 91, 91'.

The further procedure for producing the seam 71, opening the workpiece clamp, removal of the sewn workpiece cuts 72, 75 and finally folding webs 26, 26' corresponds to that of embodiment 1.

What is claimed is:

1. A workpiece clamp for a sewing device for sewing together the margins of necktie workpiece cuts, said workpiece clamp comprising:

clamping plates movable connected to each other; and lock means for releasably locking said clamping plates in positions for subsequently clamping one and both of said workpiece cuts;

said clamping plates including:

a lower plate having a profile with a tip and two lateral corners, an upper plate formed substantially in accordance with said profile, and an intermediate plate formed substantially in accordance with said profile, said lower and said intermediate plates being formed for clampably receiving a first workpiece cut, said intermediate and said upper plates being formed for clampably receiving a second workpiece cut, said intermediate plate including:

a central web means projecting on the side of said intermediate plate contacting said second workpiece cut, and lateral web means each associated to one of said corners, said upper plate including:

a central recess coacting with said central web means in said clamping position of said upper plate and said intermediate plate for forming a center fold in said clamped second workpiece cut, lateral folding elements each coacting with said lateral web means in said clamping position of said upper plate and said intermediate plate for forming corner folds in said clamped second workpiece cut, and folding means each associated with one of said corners and operably provided for folding over said formed corner folds in a common direction.

2. A workpiece clamp according to claim 1, wherein said lateral folding elements are formed with ends elastically connected to said upper plate, said folding elements coming into contact with said second workpiece cut on both sides of said lateral web means subsequently after forming said center fold while lowering said upper clamping plate on said intermediate clamping plate.

3. A workpiece clamp according to claim 2, wherein said folding elements comprise folding plates and folding members, said folding plates being arranged between said tip and said corners and being formed so as to come into contact with said second workpiece cut subsequently after forming said center fold and prior to fold action of said folding members while lowering said upper clamping plate on said intermediate clamping plate.

4. A workpiece clamp according to claim 1, wherein said intermediate clamping plate further includes bearing means for movably receiving said lateral web means.

5. A workpiece clamp according to claim 4, wherein said intermediate clamping plate further includes levers pivoted on said bearing means and formed with said web means and operably connected at their free ends to common drive means.

* * * * *